US005141372A

United States Patent [19]

Donner

[11] Patent Number: 5,141,372

[45] Date of Patent: Aug. 25, 1992

[54] COUPLING PIECE FOR RELEASABLY CONNECTING CONTAINERS

[75] Inventor: Julius Donner, Barschlüte, Fed. Rep. of Germany

[73] Assignee: Conver-Osr Ozean-Service-Reparatur-Ingenieur-technik GmbH, Fed. Rep. of Germany

[21] Appl. No.: 547,513

[22] Filed: Jul. 2, 1990

[30] Foreign Application Priority Data

Jul. 4, 1989 [DE] Fed. Rep. of Germany ..... 3921873
Dec. 11, 1989 [DE] Fed. Rep. of Germany ..... 3940881

[51] Int. Cl.[5] ..... B60P 7/13
[52] U.S. Cl. ..... 410/82; 24/287
[58] Field of Search ..... 410/77, 78, 79, 82, 410/83, 84; 220/1.5, 23.2. 23.4, 23.6; 24/287, 288, 290, 295

[56] References Cited

U.S. PATENT DOCUMENTS

| | | | |
|---|---|---|---|
| 3,368,838 | 2/1968 | Reich | 294/83 |
| 3,691,595 | 9/1972 | Backteman et al. | 24/287 |
| 3,718,218 | 2/1973 | Shields | 220/23.4 X |
| 4,082,052 | 4/1978 | Looks | 410/82 |
| 4,352,613 | 10/1982 | Bertolini | 220/1.5 X |
| 4,782,561 | 11/1988 | Hayama | 24/288 X |
| 5,012,560 | 5/1991 | Janke et al. | 24/287 |

FOREIGN PATENT DOCUMENTS

| | | | |
|---|---|---|---|
| 1581134 | 9/1970 | Fed. Rep. of Germany . | |
| 1940452 | 2/1971 | Fed. Rep. of Germany . | |
| 2212984 | 9/1972 | Fed. Rep. of Germany . | |
| 3538892A1 | 5/1986 | Fed. Rep. of Germany . | |
| 3642399A1 | 12/1986 | Fed. Rep. of Germany . | |
| 3809834A1 | 3/1988 | Fed. Rep. of Germany . | |
| 8809688.2 | 7/1988 | Fed. Rep. of Germany . | |
| 3710419A1 | 10/1988 | Fed. Rep. of Germany . | |
| 2046048 | 2/1971 | France . | |
| 58-186996 | 12/1983 | Japan . | |
| 8807006 | 9/1988 | PCT Int'l Appl. | 410/77 |
| 1337016 | 11/1973 | Sweden . | |

*Primary Examiner*—Robert J. Spar
*Assistant Examiner*—William M. Hienz
*Attorney, Agent, or Firm*—Cook, Egan, McFarron & Manzo

[57] ABSTRACT

A coupling piece for releasably connecting corner fittings of adjacent containers, especially of containers stacked on top of one another on board of ships. The coupling piece includes a single-piece housing, having a locking bolt which is rotatable to different positions by an actuating device being mounted in the housing in a longitudinally shiftable manner. The single-piece housing is provided with a passage, through which an appropriately formed cross-bar of the locking bolt can be pushed while being in an assembly position.

3 Claims, 16 Drawing Sheets

COUPLING PIECE FOR RELEASABLY CONNECTING CONTAINERS

BACKGROUND OF THE INVENTION

The invention relates to a coupling piece for releasably connecting corner fittings of adjacent containers, especially of containers stacked on top of one another on board of ships.

Coupling pieces of the type discussed here are usually called "twistlocks" in the technical jargon. They are mainly used during the transport of containers on board of ships. The coupling pieces are supposed to reliably prevent shifts of the containers relative to the ship on the one hand and relative to one another on the other hand.

In order to minimize the lay time of the ships caused by loading and discharging the containers, coupling pieces of the afore-mentioned kind have been created which work semi-automatically, so that only a minimal amount of manual labor for locking and releasing the coupling pieces is needed.

A semi-automatic coupling piece is is disclosed in DE-OS 37 10 419. The locking bolt in DE-OS 37 10 419 can be operated manually as well as by means of a prestressed spring. The known coupling piece has thus only to be manually connected to a container by prelocking it thereon which at the same time prestresses the spring. After this manual prelocking, the containers which are to be connected are placed on top of one another and then the coupling piece is automatically locked by the prestressed spring.

This known coupling piece requires a spring mechanism and a pivotable actuating lever which on the one hand are complicated to assemble and on the other hand necessitate a housing formed of several parts. Moreover, the spring mechanism and the pivotable actuating lever can lead to malfunctions of the known coupling piece.

SUMMARY OF THE INVENTION

The object of the present invention is to improve the coupling piece of the prior art such that it is easier to produce and functions more reliably.

In order to accomplish this object, the coupling piece comprises a housing, a locking block mounted rotatably therein and having oppositely situated crossbars, an actuating means for rotating the locking bolt and at least one spring means for at least partially automatically rotating the locking bolt. Preferably, the actuating means is mounted in the housing in a longitudinally shiftable manner for rotating the locking bolt by means of a respective longitudinal shift of the actuating means in the housing. The shiftable arrangement of the actuating means in the housing has several advantages, some of which are rather surprising. On the one hand, the longitudinal shift of the actuating means results in the locking bolt being easier to rotate than the prior art rotatable actuating means. On the other hand, the actuating means of the present invention is easier to assemble, especially with coupling pieces having a housing formed of one piece. Finally, the longitudinally shiftable actuating means allows a reliable visual inspection at least of the exact locking position at any relative arrangement of the coupling piece. This is not possible with known coupling pieces with rotatable actuating means, because the rotatable actuating means point in different directions when locked, depending on the arrangement of these known coupling pieces between the containers. Since the actuating means of the coupling piece of the present invention is longitudinally shiftable, there are no differences in this respect, no matter if the coupling piece is arranged in the one or in the other position between the containers.

According to a preferred embodiment of the coupling piece of the present invention, the actuating means and the locking bolt, in particular a middle piece connecting the oppositely situated crossbars, are in engagement via a gear. In another preferred embodiment, this engagement is made by means of a portion of the elongated actuating means having a toothing, so that said actuating means is quasi designed as a gear rack, and at least part of the periphery of the middle piece of the locking bolt also has a toothing which is formed to correspond to the toothing of the actuating means. This gear connection guarantees that the locking bolt with its crossbars can be moved into appropriate positions, namely into a locking and a released or partially released position, by simply sliding the elongated actuating means to and fro. The toothing ensures a reliable transmission of movements between the elongated actuating means and the locking bolt, even at low temperatures when the coupling pieces are covered with ice. This almost completely rules out the risk of damaging the coupling piece when the ice is broken or when the coupling piece is actuated in unfavorable operating conditions of any other kind.

Alternatively it is also possible to connect the actuating means and the locking bolt, i.e. again its middle part, by a resilient actuating means. In a preferred embodiment of the invention, this means is designed as a wrap spring. The latter has a spring coil being non-shiftably and non-rotatably connected to the middle portion of the locking bolt and a spring tongue projecting opposite the middle portion. The spring tongue is hinged to the actuating means. When the locking bolt is rotated and the position of the actuating means remains unchanged, the wrap spring can be deformed, while bracing itself against the actuating means on the one hand and the middle part of the locking bolt on the other hand. By means of the energy stored therewith, the locking bolt can be rotated automatically, i.e. without shifting the actuating means, at least into a locking position for connecting two containers placed on top of one another.

A coupling piece which also accomplishes the object of the present invention comprises a housing, a locking bolt mounted rotatably therein and having oppositely situated crossbars, an actuating means for rotating the locking bolt and at least one spring means for at least partially automatically rotating the locking bolt. Preferably, the housing is formed of a single piece and has openings, through which one of the crossbars, the actuating means and the spring means can be passed. As a result of the housing being provided with such openings through which the locking bolt with a crossbar, the actuating means and the spring means can be passed, the housing can be formed of one piece. The invention therefore creates a semi-automatic coupling piece with a single-piece housing. Assembly of the coupling piece is also facilitated because the spring means can be inserted into the housing together with the locking bolt or the actuating bolt, i.e. as an assembly-unit.

Further embodiments relate to advantageous embodiments of the locking bolt, the actuating means or the spring means.

BRIEF DESCRIPTION OF THE DRAWINGS

The preferred embodiments of the coupling piece are described in more detail below with reference to the drawings which show.

DETAILED DESCRIPTION OF THE PRESENTLY PREFERRED EMBODIMENTS

Figure 2:
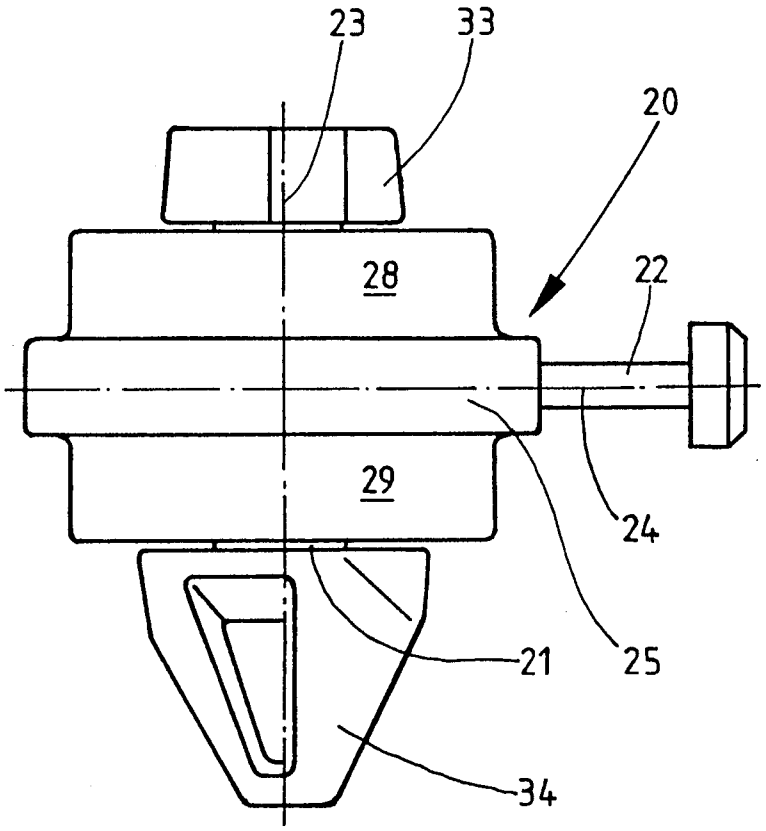
FIG. 2 is a side view turned by 90° of the coupling piece in a position as shown in FIG. 1.

The coupling piece according to an embodiment of the invention comprises a housing 20, a locking bolt 21 and an actuating slide 22. The locking bolt 21 is mounted to rotate about a vertical longitudinal mid-axis 23 in the housing 20. The actuating slide 22 on the other hand is arranged shiftably along its mid-axis 24 in the housing 20.

Figure 1:
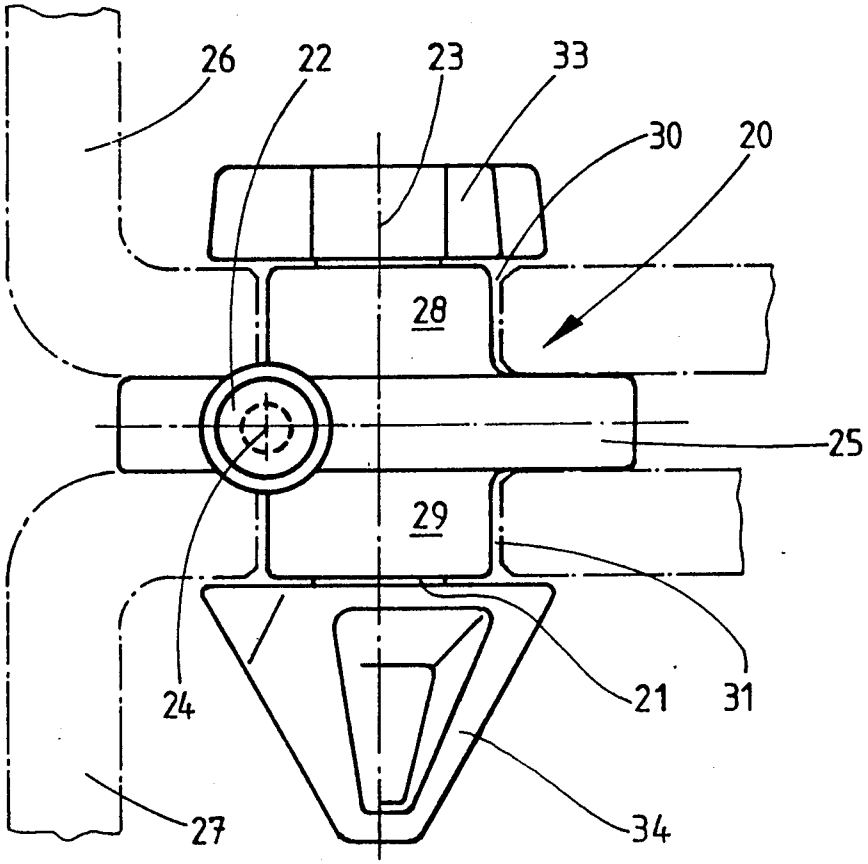
FIG. 1 is a side view of the coupling piece in a locking position between two container corner fittings.

The housing 20 of the coupling piece is formed of a single piece. It is divided into three portions, i.e. it has a central abutment 25 which functions as a spacer between the respective corner fittings 26 or 27 (in FIG. 1 sketched out by dot-dash lines) when the containers are connected, and two middle pieces 28, 29 at opposite sides of the abutment 25. The middle pieces 28 and 29 are connected (in one piece) with the abutment 25 and formed appropriately to enter corresponding long holes 30, 31 of the corner fittings 26; 27 of adjacent containers (FIG. 1).

The locking bolt 21 has an approximately cylindrical middle part 32 and two crossbars 33 and 34 connected in one piece with oppositely situated ends of the middle part 32. The crossbars 33 and 34 are attached to the middle part at an offset angle relative to one another such that their longitudinal axes 35 or 36 extending transverse to the longitudinal mid-axis 23 of the locking bolt 21 form an angle which is 60° in the shown embodiment, but which could also be larger or smaller. Moreover, the crossbars 33 or 34 are designed differently. The crossbar 33 being the upper crossbar in the drawing has a central cylinder portion 37 which approximately corresponds to the cross-section of the middle part 32 and two wing portions 38 at opposite sides of the cylinder portion 37 which approximately have the shape of unequalsided trapezoids. The relative position of these trapezoidal wing portions 38 at cylinder portion 37 is chosen such that the rounded long trapezoid sides 39 of the present embodiment extend at the outer sides of the crossbar 33. Due to the unequalsided trapezoidal form of the wing portions 38, the crossbar 33 has a straight longitudinal side 40 extending parallel to its longitudinal axis 35. At the side of the cylinder portion 37 lying opposite the straight longitudinal side 40 on the other hand, there are two grooves 41 at opposite sides of the cylinder portion 37 (see for example FIG. 5) because of the trapezoidal form of the wing portions 38. The lower crossbar 34 of the drawing is designed such that it tapers and is provided with relatively distinct roundings which are wound helicoidally towards the end. The pitch of the winding is dimensioned such that the crossbar 34 is automatically rotatable when inserted into the corner fitting 27 of the assigned container. In this respect, the crossbar 34 is of a similar design as the one of the coupling piece as disclosed by DE-OS 37 10 419, which is referred to in this respect but also regarding further details.

Figure 3:
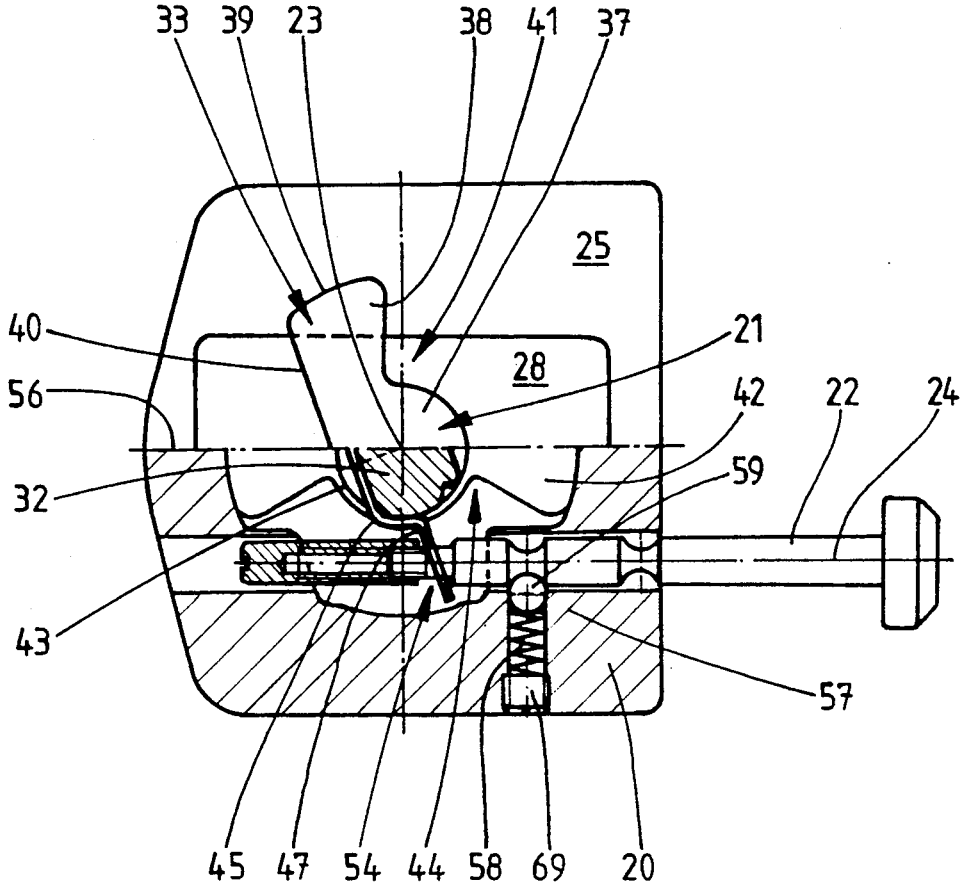
FIG. 3 is a plan view of a section coupling piece of FIGS. 1 and 2.

A central upright passage 42 extends through the housing 20, specifically through the abutment 25 as well as the middle pieces 28 and 29. In this passage 42, the locking bolt 21 is rotatably mounted with its middle part 32, so that the crossbars 33 and 34 are outside the housing 20 and project from the middle pieces 28, 29. The passage 42 is designed in a special way in the housing 20. It has a cross-section corresponding to the upper crossbar 33, the dimensions being chosen such that they are slightly bigger than those of the upper crossbar 33. This ensures that the locking bolt 21, being in an assembly position, can be pushed through the housing 20 with the upper crossbar 33 when the coupling piece is assembled. After the assembly has been completed, the middle part 32 of the locking bolt 21 is rotatably mounted in the center portion 43 of the passage 42 which is formed to correspond to the cylinder portion 37 of the upper crossbar 33. Projections 44 corresponding to the grooves 41 at opposite sides of the center portion 43 of the passage 42 hold the middle part 32 of the locking bolt 21 in the passage 42 so that it cannot be laterally shifted. The projections 44 at the passage 42 additionally ensure that the locking bolt 21, turned by 180° relative to the assembly position, does not get into a position congruent with the passage 42 when the upper crossbar 33 is inserted into the corner fitting 26 of a respective container and thus falls out of the housing 20 (FIG. 3).

Alternatively, the upper crossbar 33 as well as the passage 42 can be provided with basal surfaces or cross-sections different to those shown in the drawings, as long as they have at least the afore-described features.

Figure 6:
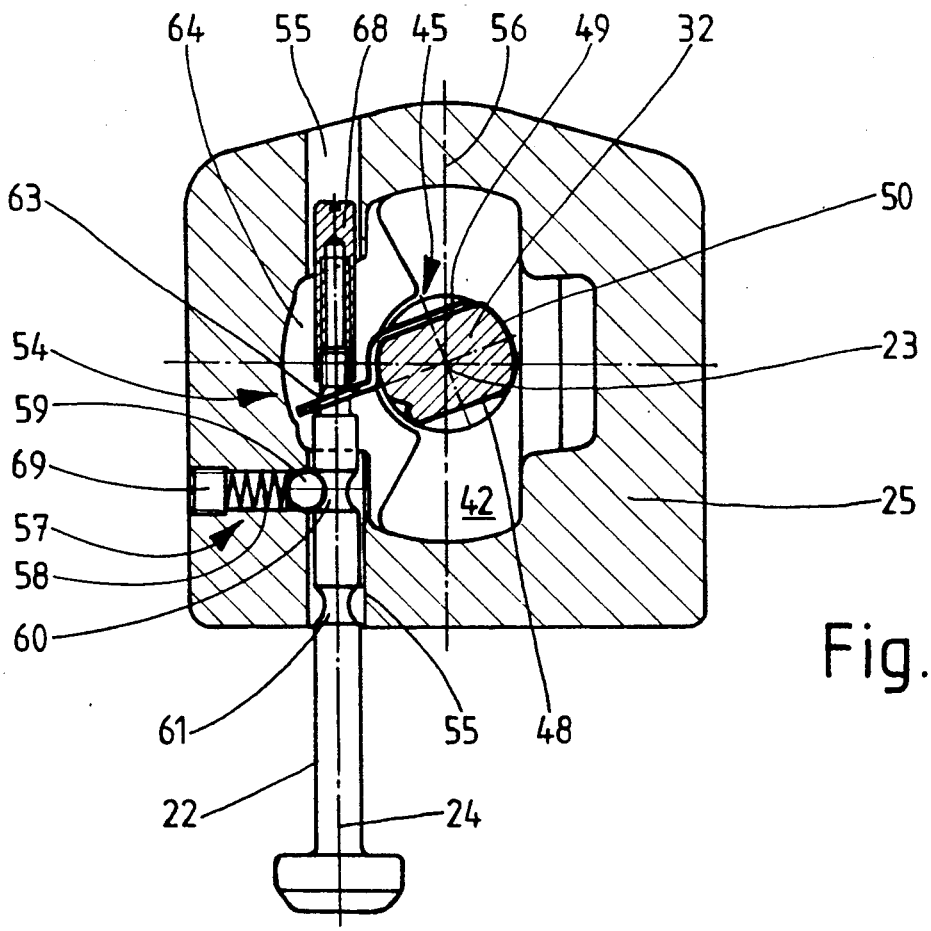
FIG. 6 is a central horizontal section through the coupling piece with a crossbar and an actuating slide being in prelocked position.

In this embodiment, the spring means for automatically rotating the locking bolt 21 is in the form of a wrap spring 45. The wrap spring 45 is connected to the middle part 32 of the locking bolt 21, approximately central, in an axially rigid and non-rotatable manner. The wrap spring 45 consists of a spring coil 46 approximately completely encircling the middle part 32 and a spring tongue 47. The spring coil 46 is essentially formed in a U-shaped manner and has two parallel legs 48, 49 which are connected to one another by a crosspiece 50 (FIG. 6). The free end of a leg 48 is provided with a hook-like bend 51, which engages a corresponding depression 52 in the middle part 32 and thus guarantees that the wrap spring 45 is non-rotatably secured. The straight legs 48, 49 each rest in a notch 53 in the form of a circular segment in the cylindrical middle part 32, which guarantees that the wrap spring 45 can not be shifted relative to the longitudinal mid-axis 23 of the middle part 32 (FIG. 6).

The spring tongue 47 is designed as an extension of the (second) leg 49 of the spring coil 46. For this purpose it is cranked relative to the leg 49, specifically such that when the wrap spring 45 is slack, the spring tongue 47 projects laterally relative to the middle piece 32 in a central position between the legs 48, 49 and approximately extending parallel thereto, i.e. extending approximately on the longitudinal axis of the upper crossbar 33 (FIG. 6).

The wrap spring 45 has a special relative arrangement because said wrap spring 45, especially its transversely projecting spring tongue 47, is congruent to the upper crossbar 33 which is corresponding to the passage 42 (FIG. 3). This arrangement ensures that for assembling the coupling piece, the locking bolt 21 can be pushed through the passage 42 together with the upper crossbar 33 and the wrap spring 45 although the spring tongue 47 is transversely projecting.

In the shown embodiment the wrap spring 45 is formed of two parts. For this purpose, the spring coil 46 is made of a resilient material, whereas the separate spring tongue 47 is made of a non-resilient material or a material which is less resilient than that of the wrap spring 45. Alternatively it is possible to form the wrap spring 45 of one piece, so that the spring coil as well as the spring tongue have practically identical resilient properties.

For manual operation—in addition to the automatic operation by the wrap spring 45—the locking bolt 21 is positively coupled to the actuating slide 22 via the wrap spring 45. This is achieved by an articulated connection 54 between the actuating slide 22 on the one hand and the spring tongue 47 of the wrap spring 45 on the other hand (FIG. 6).

The elongated actuating slide 22 is mounted in a longitudinally shiftable way in a through bore 55 in the abutment 25 of the housing 20. The through bore 55 extends parallel to a mid-axis 56 of the housing 20 which is directed transverse through the longitudinal mid-axis 23 of the locking bolt 21, which means that said through bore 55 lies next to the passage 42, so that the mid-axis 24 of the actuating slide 22 extends parallel to the mid-axis 56 of the housing 20 (FIG. 6). The actuating slide 22 can be locked in two alternative slide positions in the housing 20 by means of a lock-in means 57 such that the actuating slide 22 can not move to another slide position in the housing 20 because of the stressed wrap spring 45. For this purpose, the lock-in means 57 is provided with a lock-in ball 59 loaded by a compression spring 58 which is mounted in the abutment 25 of the housing 20 and which engages corresponding depressions of the actuating slide 22. In the present embodiment, these depressions are designed as two spaced out circumferential index notches 60 and 61 in the actuating slide 22.

The articulated connection 54 between the actuating slide 22 and the wrap spring 45 is achieved on the one hand by a step 62 reducing the diameter of the locking bolt 21 and on the other hand by a bore 63 in the spring tongue 47 having a diameter greater than that of the step 62. Instead of the bore 63, the spring tongue 47 can also be provided with a horizontally extending long hole or the like for forming the articulated connection 54. Due to the overdimension of the bore 63 or the long hole or the like relative to the step 62, the spring tongue 47, in order to form different turning positions of the locking bolt 21 or to prestress the wrap spring 45, can get into different angular positions to the actuating slide 22 without jamming or forcing the actuating slide 22. For this purpose, there is also disposed a lateral clearance 64 extending from the passage 42 in the housing 20, specifically in the region of the abutment 25 thereof. In this clearance 64, the spring tongue 47 can be pivoted from the assembly position into the releasing position and therefrom into the prelocking and the locking position.

Figure 8:
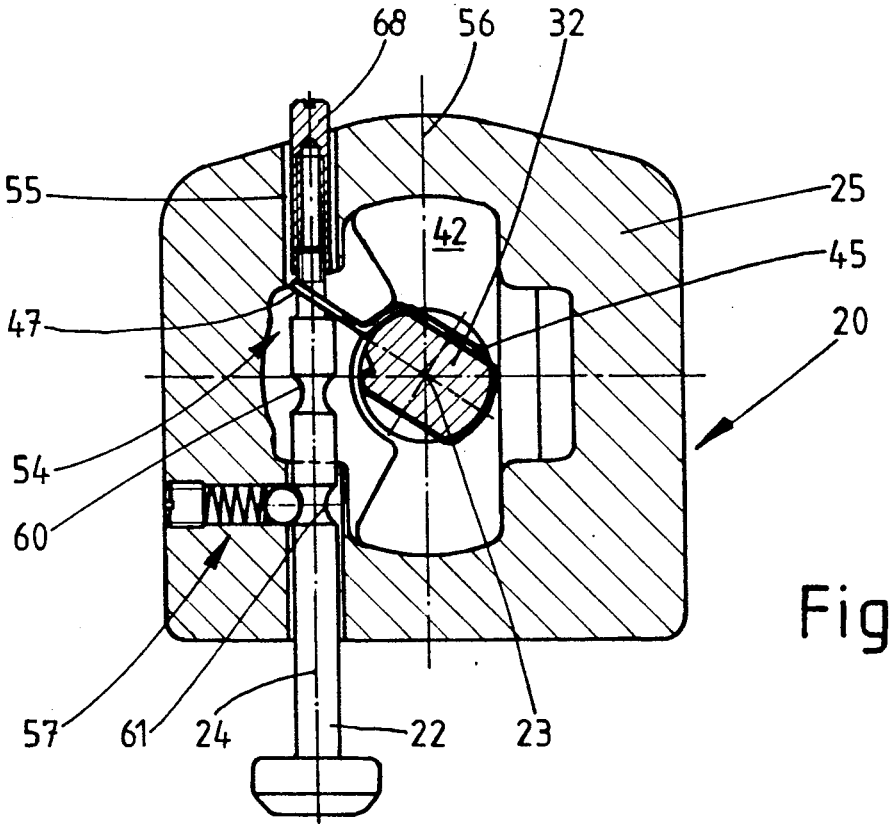
FIG. 8 is a central horizontal section through the coupling piece with a crossbar and an actuating slide being in a final locking position, but with the containers not yet coupled together.

The step 62 for the articulated connection 54 is arranged in the region of a free end 65 of the actuating slide 22, so that the spring tongue 47 is only held on one side at the point where the step 62 merges into the other portion of the actuating slide 22 with greater diameter. In order to have a counterstop at the side directed to the free end 65 of the actuating slide 22 for the complete positive connection of the wrap spring 45 to the actuating slide 22, the step 62 is provided with an external thread 66 on the end, on which a stop socket 68 having a corresponding interior thread 67 can be screwed on. The outer diameter of this stop socket 68 approximately corresponds to the diameter of the portion of the actuating slide 22 adjoining the step 62. The length of the stop socket 68 is chosen such that in both lock-in positions of the actuating slide 22 it is guaranteed that said actuating slide 22 is guided at opposite sides of the clearance 64 in the housing 20, namely in the through bore 55 (FIGS. 6 and 8).

The coupling piece is assembled such that first, in an assembly position with the wrap spring 45 being placed on the locking bolt 21, the upper crossbar 33 is passed through the passage 42 in its assembly position and subsequently turned by approximately 180°, so that said upper crossbar 33 is not congruent with the passage 42 anymore, and the spring tongue 47 of the wrap spring 45 enters the region of the clearance 64 in the abutment 25 of the housing 20 (see for instance FIG. 3). The actuating slide 22, without having the stop socket 68 screwed on its free end 65, can then be pushed into the through bore 55 and passed through the bore 63 in the spring tongue 47. In order to positively connect the wrap spring 45 to the actuating slide 22, the stop socket 68 is then srewed on the free end 65 of said actuating slide 22 and thereafter, the lock-in ball 59 is placed into the housing 20 with the compression spring 58 of the lock-in means 57 and secured by a headless screw 69. The necessary lock-in force of the lock-in means 57 can be adjusted by the screw-in depth of the headless screw 69 into the housing 20.

The procedure of locking and releasing the above-described coupling piece will be described in more detail with respect to FIGS. 4 to 11.

Figure 7:
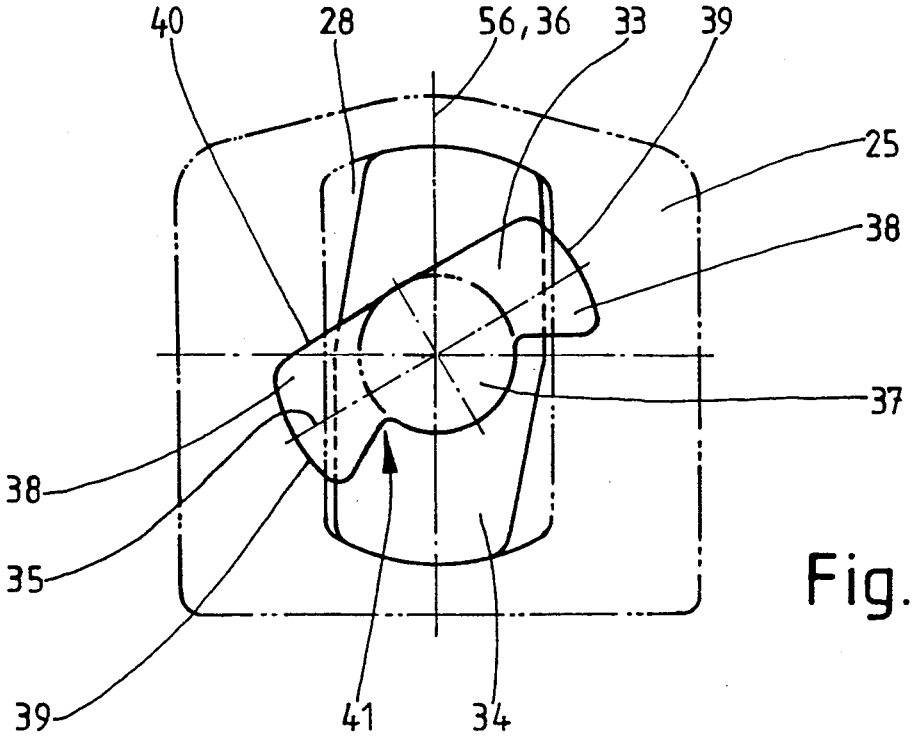
FIG. 7 is a plan view of the coupling piece as shown in FIG. 6.

The process of locking the coupling piece starts out from a releasing position, in which the wrap spring 45 is slack and the actuating slide 22 is pulled out of the housing 20 up to the index notch 60. In this position, the upper crossbar 33 is out of alignment with the mid-axis 56 of the housing 20 while the lower crossbar 34 is approximately aligned to the mid-axis 56 (FIGS. 6 and 7).

Figure 4:
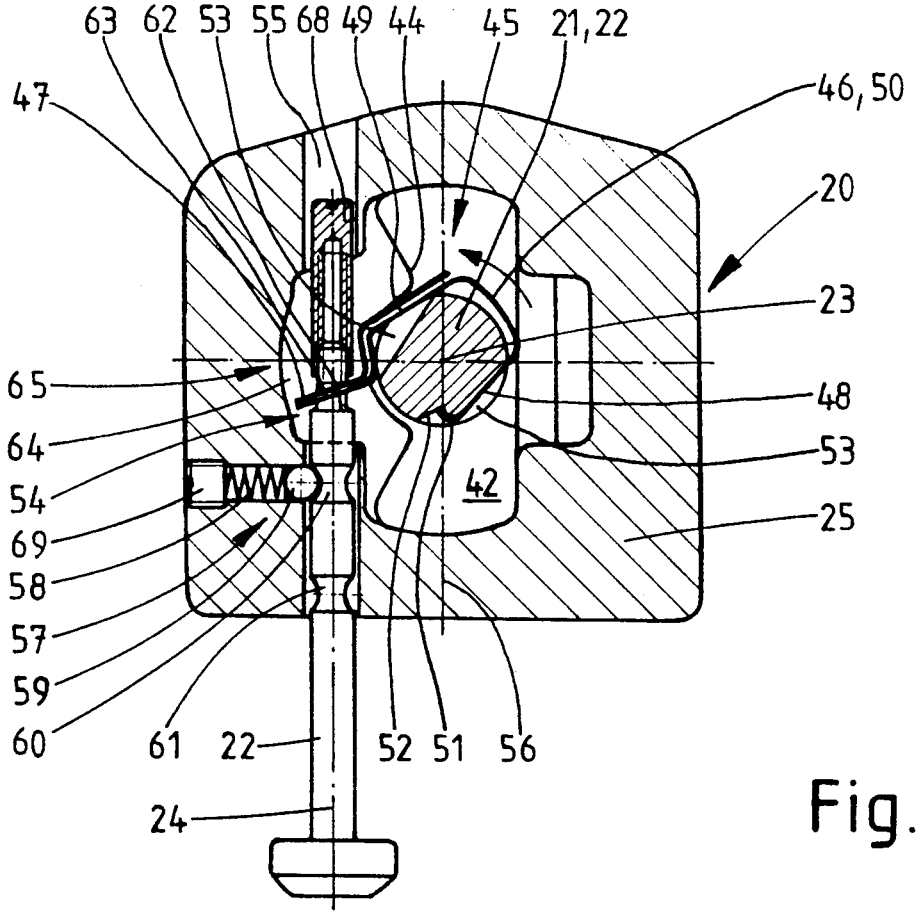
FIG. 4 is a central horizontal section through the coupling piece with an upper crossbar turned to a releasing position.
Figure 5:
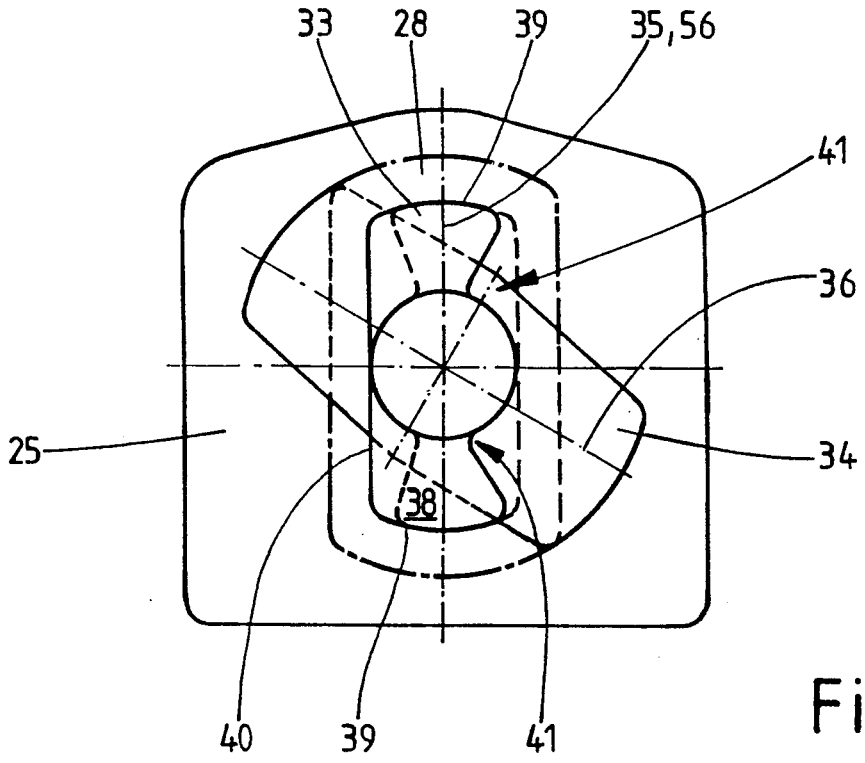
FIG. 5 is a plan view of the coupling piece in a position as shown in FIG. 4.

By turning the locking bolt 21 at the lower crossbar 34, the upper crossbar 33 is moved from the releasing position into alignment with the mid-axis 56, the wrap spring 45 being prestressed at the same time (FIGS. 4 and 5). With the locking bolt 21 being in this position, the coupling piece can be inserted into the lower corner fitting 26 of the upper container. By letting go of the locking bolt 21, the latter is rotated by the prestressed wrap spring 45, the upper crossbar 33 taking up a pre-locking position (FIGS. 6 and 7).

Figure 9:
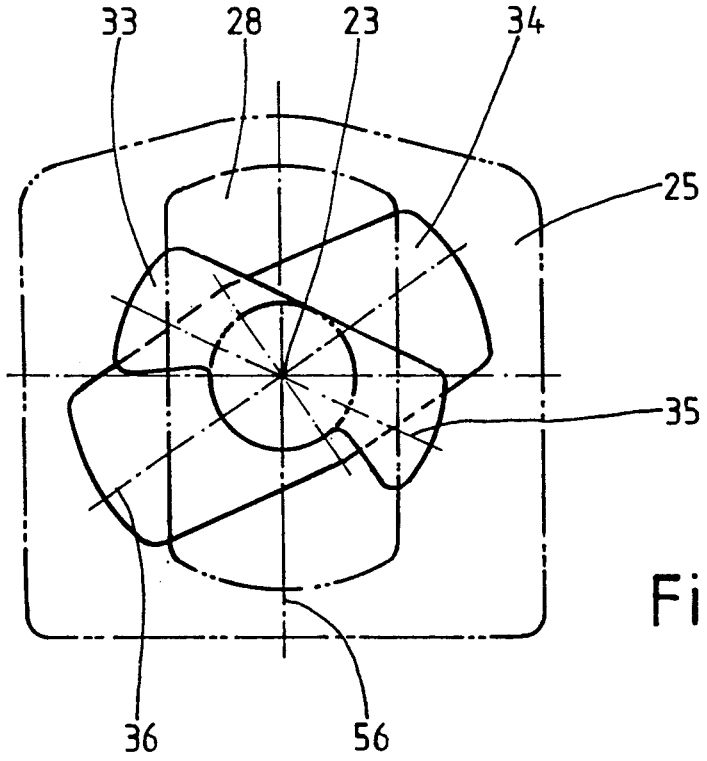
FIG. 9 is a plan view of the coupling piece in a position as shown in FIG. 8.

By pushing the actuating slide 22 into the housing up to the index notch 61, the coupling piece reaches the locking position in which both crossbars 33 and 34 are offset to the mid-axis 56 of the housing 20. The wrap spring 45, however, is (still) slack (FIGS. 8 and 9).

Figure 10:
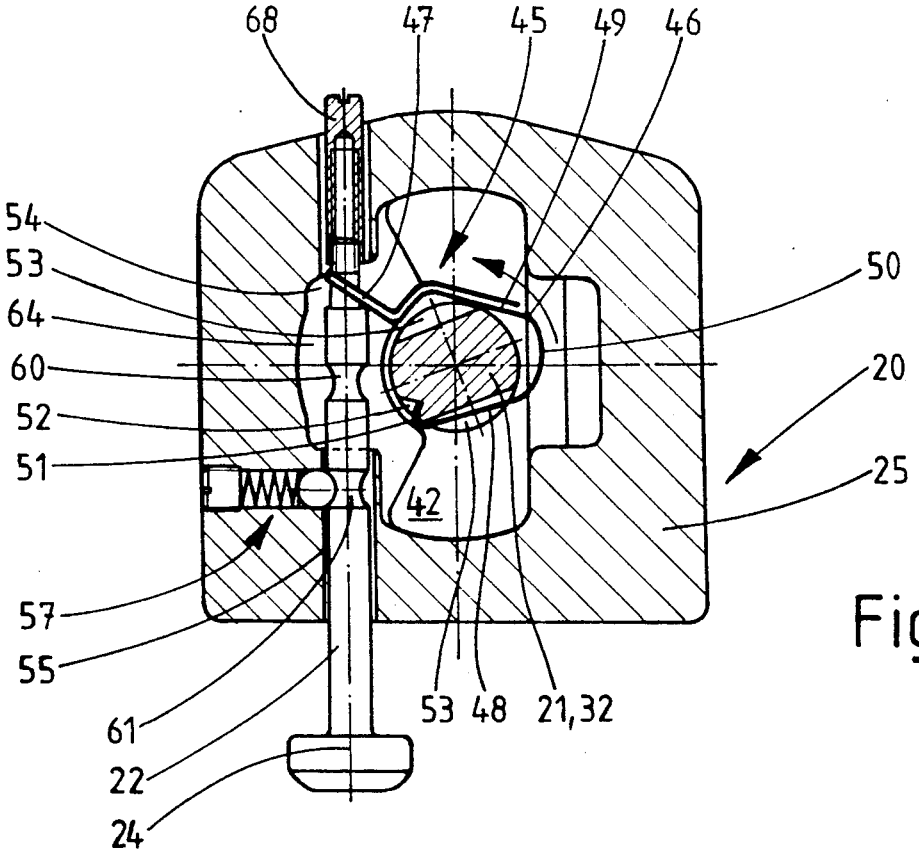
FIG. 10 is a central horizontal section through the coupling piece during insertion of the lower crossbar into a lower container with the actuating slide being in released position.
Figure 11:
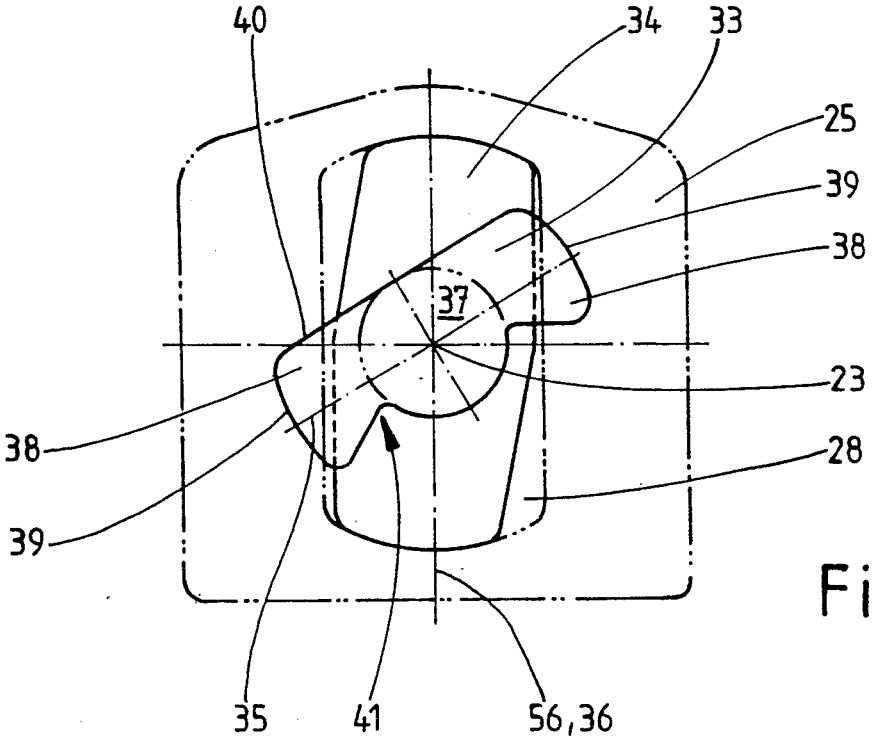
FIG. 11 is a plan view of the coupling piece in a position as shown in FIG. 10.

When the upper container with the coupling piece hanging underneath is lowered down onto the upper corner fitting 27 of the lower container, the helicoidal winding of the lower crossbar 34 effects the locking bolt 21, while the wrap spring 45 is prestressed at the same time, to be turned until the mid-axis 36 of the lower crossbar 34 is approximately lying on the mid-axis 56 of the housing 20, so that said lower crossbar 34 can be inserted into the upper corner fitting 27 of the lower container (FIGS. 10 and 11).

As soon as the upper container has been lowered completely onto the lower container, the prestressed wrap spring 45 causes the locking bolt 21 to be automatically turned back until the wrap spring 45 is completely slack again, at which point the final locking position of the coupling piece has been reached, which means that the mid-axes 35, 36 of both crossbars 33, 34 are extending at an angle to the mid-axis 56 of the housing 20 (FIGS. 8 and 9), so that the containers are coupled together.

In order to release the coupling piece, the actuating slide 22 has to be pulled out of the housing back to the index notch 60, the locking bolt 21 being rotated until, without any substantial prestressing of the wrap spring 45, the longitudinal axis 36 of the lower crossbar 34 is approximately aligned with the mid-axis 56 of the housing 20, so that the upper container including the coupling piece still coupled thereto can be lifted off the lower container (FIGS. 6 and 7).

The coupling piece can then be released from the upper container by manually turning the locking bolt 21 at the lower crossbar 34 until the upper crossbar 34 is approximately aligned with the mid-axis 56 of the housing 20. Here, the wrap spring 45 is again stressed (FIGS. 4 and 5). After letting go of the locking bolt 21, it is rotated back to its starting position (in which the wrap spring 45 is slack) by the stressed wrap spring (FIGS. 6 and 7). The coupling piece can then be used again for a new locking process in the above-described way.

According to a second embodiment of the invention, the coupling piece also has a housing 70 formed of a single piece, in which a locking bolt 71 and an actuating slide 72 are mounted. The locking bolt 71 is again mounted in the housing 70 to rotate about the vertical longitudinal mid-axis 23, while the actuating slide 72 is arranged in the housing 70 such that it is shiftable along the mid-axis 24.

Just like with the coupling piece of the previous embodiment, the housing 70 is divided into three portions. This means that it has a central abutment 25, which functions as a spacer between the respective corner fittings when the containers are coupled together, and two projecting middle pieces 28, 29 at opposite sides of the abutment 25. These middle pieces 28, 29 are designed like the ones of the housing of the first embodiment of the coupling piece.

Figure 13:
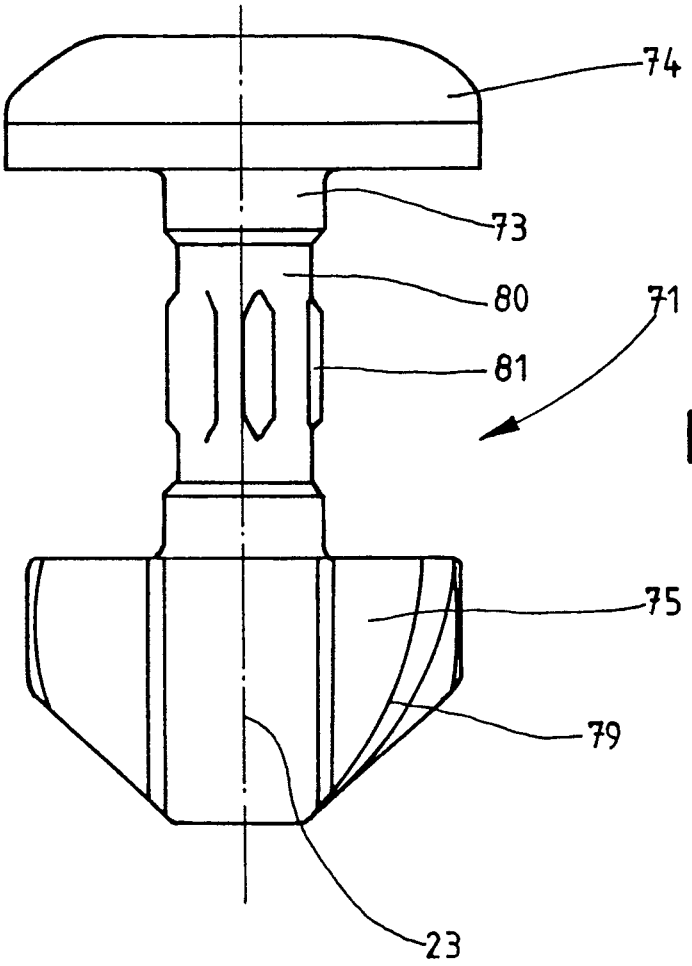
FIG. 13 is a side view of a locking bolt of the coupling piece of FIG. 12.
Figure 14:
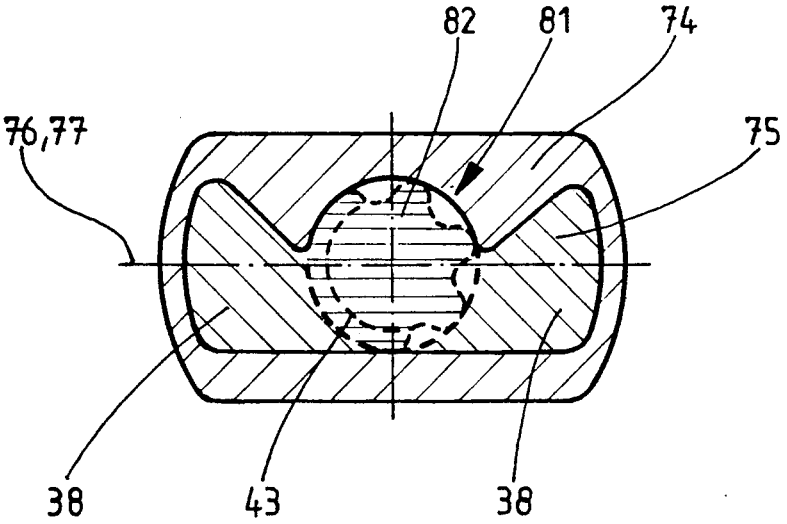
FIG. 14 is a plan view of the locking bolt as shown in FIG. 13.

The locking bolt 71 has an approximately cylindrical middle part 73 and two crossbars 74, 75 at opposite ends thereof which are integrally attached to the middle part 73. In contrast to the previous embodiment, the crossbars 74, 75 are arranged at the middle part 73 such that their longitudinal axes 76 or 77 are congruent and extend transverse to the longitudinal mid-axis 23 of the locking bolt 71 (FIGS. 13 and 14).

Figure 12:
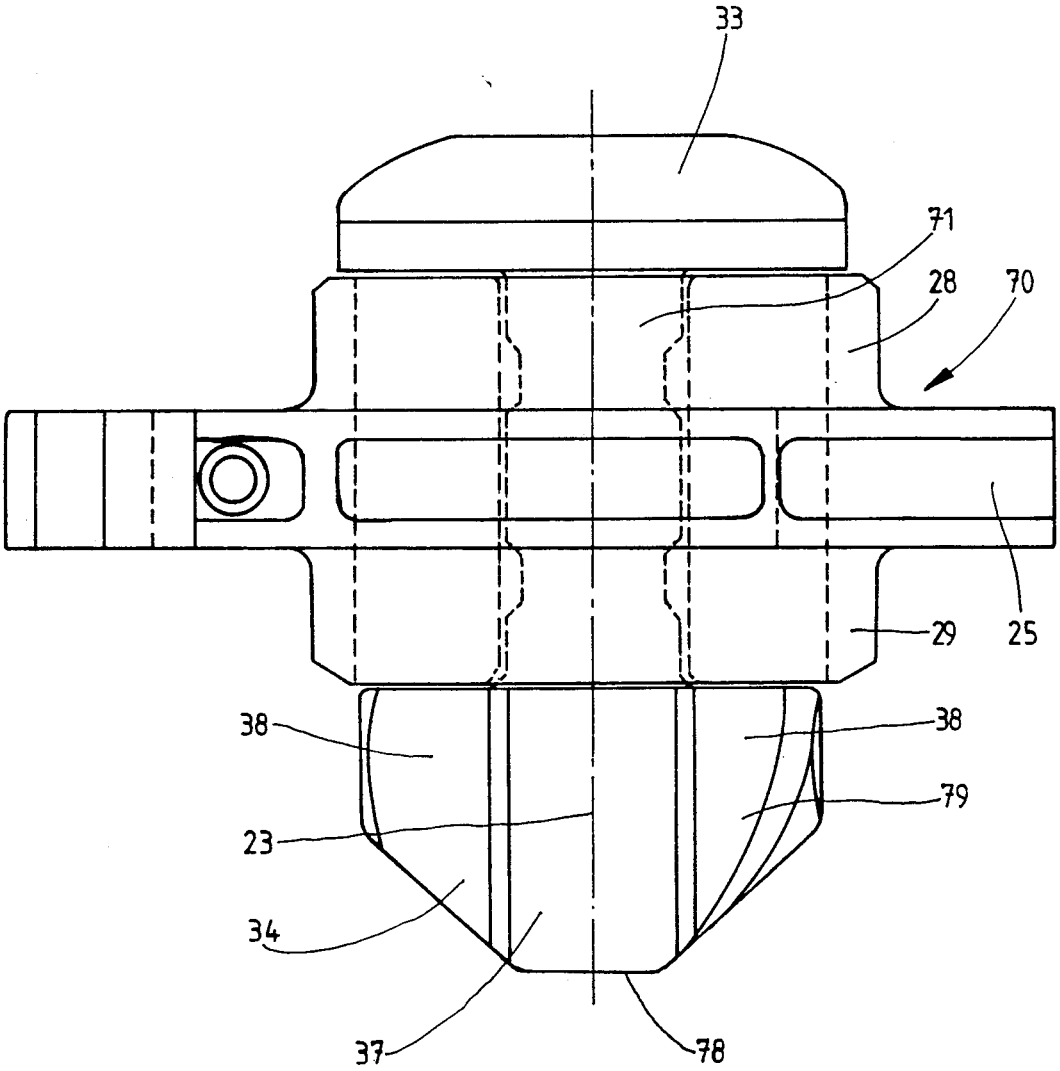
FIG. 12 is a side view of a coupling piece according to a second embodiment in a releasing position.
Figure 20:
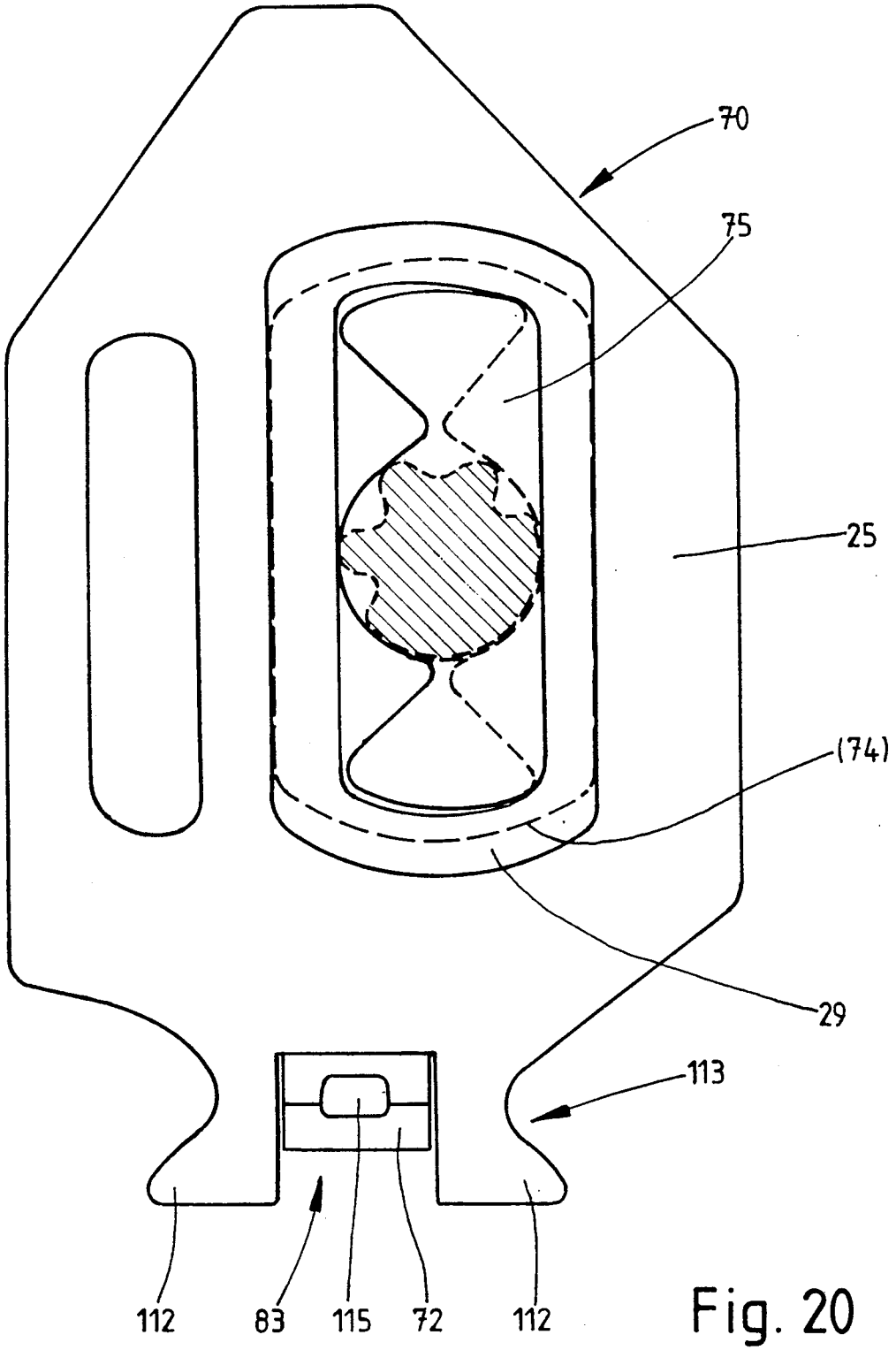
FIG. 20 is a view of the coupling piece as shown in FIG. 19 from underneath.

Here, the upper crossbar 74 is in the form of a flat plate, with a cross-section approximately corresponding to that of the middle pieces 28, 29 (FIG. 20). The (lower) crossbar 75 on the other hand has a cross-section which approximately corresponds to that of the (upper) crossbar 33 of the coupling piece of the first embodiment, which means that it consists of a central cylindrical portion 37 and two oppositely situated wing portions 38. In contrast to the first embodiment, however, the surface of the (lower) crossbar 75 is not plane but slightly tapering. For this purpose, the opposite wing portions 38 are bevelled towards the free end 78 of the cylinder portion 37. Furthermore, diagonally opposite corner regions of the wing portions 38 are provided with helicoidal windings 79 extending in the direction of the longitudinal mid-axis 23. The pitch of the windings 79 is dimensioned such that the (lower) crossbar 75 is automatically rotatable when inserted into the corner fitting of a (lower) container (FIGS. 12 and 13).

The shown embodiment of the coupling piece also has a passage extending through the housing 70 which corresponds to the passage 42 of the housing 20. This means that in this embodiment too the cross-section of the passage 42 is corresponding to the cross-section of the (lower) crossbar 75, so that said crossbar 75 can be placed into the (single-piece) housing 70 together with the middle part 73 of the locking bolt 71 in the assembly position. After the locking bolt 71 is turned by 180° following the assembly, it is ensured by the design of the passage 42 in the housing 70 on the one hand and the corresponding cross-section of the (lower) crossbar 75 on the other hand, that the locking bolt 71 can not fall out of the housing 70 any more (FIG. 20).

In the present embodiment of the coupling piece, the middle part 73 of the locking bolt 71 is designed in a special way. A central portion of said middle part 73 is provided with a limited diameter reduction 80 on which a toothing 81 is disposed extending across part of the periphery of the middle part 73. In the shown embodiment, the toothing 81 extends approximately across half of the periphery of the middle part 33 and forms three teeth 82, which have a round section and which are in alignment with the cross-section of the middle part 73 beyond the diameter reduction 80 (FIGS. 13 and 14). In the non-toothed region, the middle part 73 extends continuously flush between the crossbars 74, 75.

Figure 15:
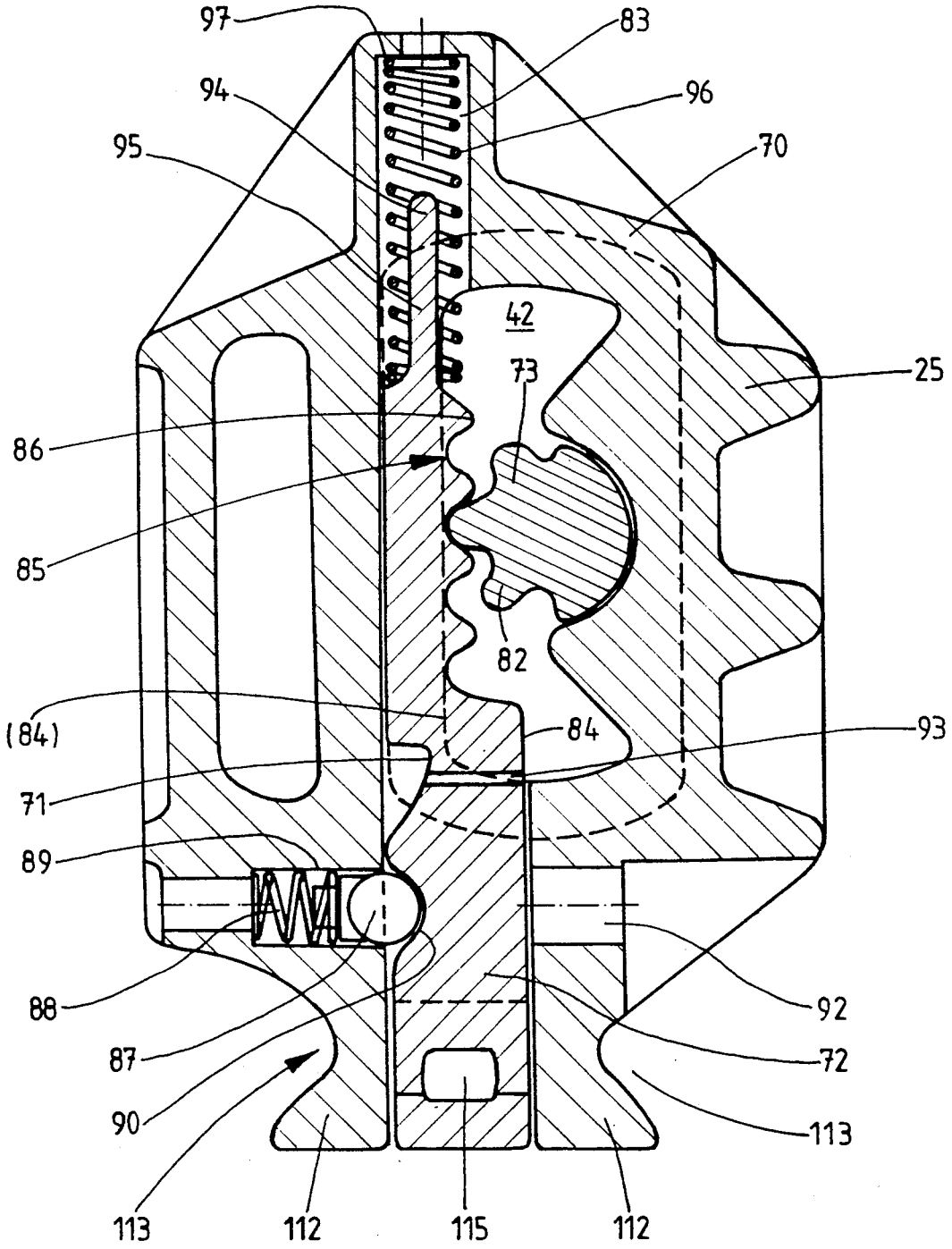
FIG. 15 is a horizontal section through the coupling piece of FIG. 12 in a locking position.

Next to the passage 42 for the locking bolt 71 there is a further elongated opening 83 in the housing 70 for holding the actuating slide 72 in a longitudinally shiftable way. The mid-axis 24 of the elongated opening 83 therefore extends transverse to the longitudinal mid-axis 23 of the locking bolt 71, specifically approximately tangentially (laterally) along the passage 42, which means that it approximately extends in a continuous straight side face 84 in the abutment 25 of the housing 70 (FIGS. 12 and 15).

On a side facing the locking bolt 71, namely its toothing 81, the elongated actuating slide 72 is provided with a corresponding elongated toothing 85 which has four teeth 86 in the present embodiment. The toothing 81 on the locking bolt 71 and the longitudinal toothing 85 on the actuating slide 72 engage one another, so that a movement of the actuating slide 72 along its mid-axis 24 effects a rotation of the locking bolt 71 with the crossbars 74, 75 attached thereto (FIG. 15).

Figure 17:
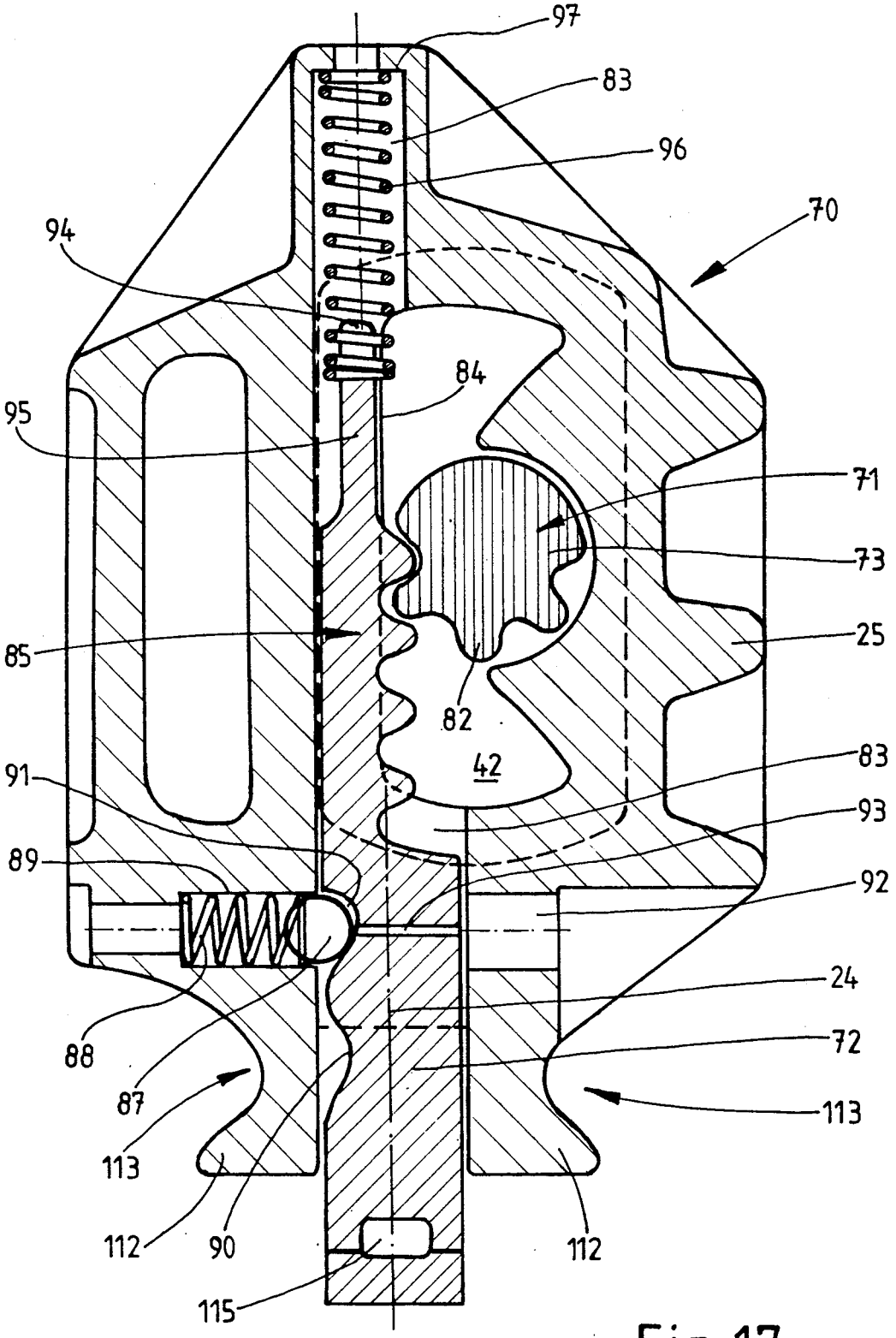
FIG. 17 is a horizontal section through the coupling piece of FIG. 12 in a partially released position.

The actuating slide 72 which can be pushed along the mid-axis 24 into the housing 70 via an opening 73 which opens out in one side of the housing 70, can be secured against falling out of the housing 70 by a lock-in means, namely a lock-in ball 87. This lock-in ball 87, prestressed by a spring 88, is mounted in the housing 70, namely in a location bore 89, such that said lock-in ball 87 partly extends into the elongated opening 83 and contacts a side of the actuating slide 72 opposite the longitudinal toothing 85 (FIG. 15). At this side, the actuating slide 72 has two depressions 90 and 91 formed in correspondence to the lock-in ball 87. The depressions 90, 91 are arranged and spaced apart on the actuating slide 72 such that the lock-in ball 87 secures the actuating slide 72 in a locked as well as in a partially released position. In the latter position, the depression 91 also ensures that the actuating slide 72 can not slide out of the housing 70 (FIGS. 15 and 17).

The length of the actuating slide 72 is dimensioned such that when the actuating slide 72 is locked, it is approximately flush with the side of the housing 70 in which the elongated opening 83 opens out to receive the actuating slide 72.

In order to put the lock-in ball 87 with the spring 88 into its place when the coupling piece is assembled, a corresponding through bore 92 is disposed in the housing 70 at the side of the elongated opening 83 opposite the lock-in ball 87. Before the assembly of the actuating slide 72, the spring 88 and then the lock-in ball 87 can be inserted into the location bore via said through bore 92 (FIG. 15).

For the dismantling of the actuating slide 72, a thin longitudinal bore 93 is disposed in the region of the front depression 91 which extends transversely through the actuating slide 72. When the locking bolt 71 is in a partially released position, the lock-in ball 87 can be disengaged from the depression 91 by means of the longitudinal bore 93 and the adjacent through bore 92 in the housing 70 by completely pushing said lock-in ball 87 into the location bore 89 by means of an appropriate tool, so that the acuating slide 72 can be pulled out of the elongated opening 83 in the housing 70 unhindered.

At a free end 94 pointing into the inside of the housing 70, the actuating slide 72 is provided with a pin-shaped guide portion 95. A compression spring 96 is pushed onto part of this guide portion 95, which is on the one hand braced against the actuating slide 72, namely the end of the guide portion 95, and on the other hand against the bottom 97 of the elongated opening 83 in the housing 70. The actuating slide 72 can thus, by means of the (prestressed) compression spring 96, be shifted from a completely released position of the locking bolt 71 (FIG. 19) to the locking position (FIG. 15) while the locking bolt 71 is rotated correspondingly at the same time.

Figure 21:
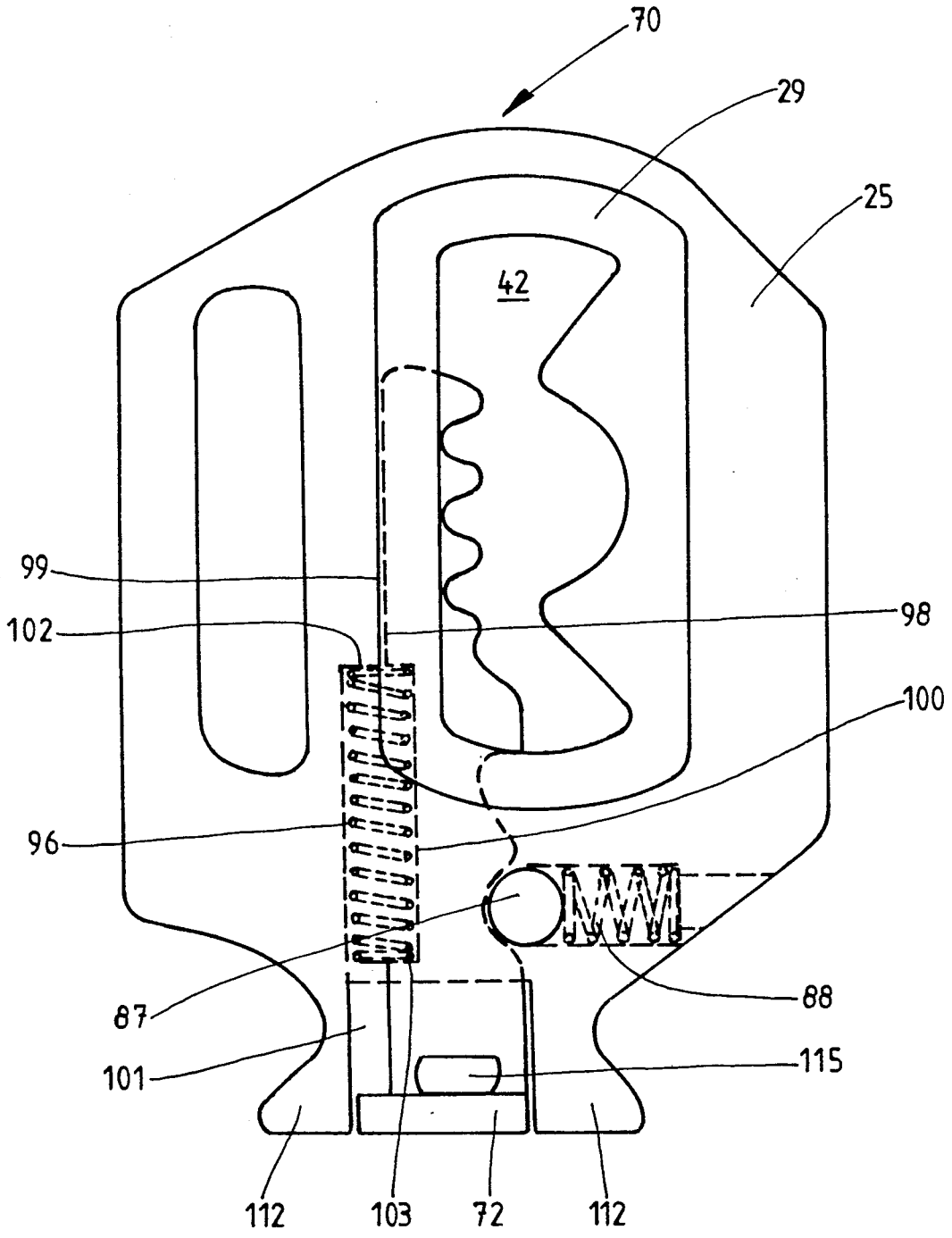
FIG. 21 is a plan view of a third embodiment of a coupling piece.

Alternatively it is possible to mount the compression spring 96 between longitudinal sides 98, 99 of the housing 70 on the one hand and the actuating slide 72 on the other hand which are facing one another. For this purpose, the actuating slide 72 is provided with an elongated recess 100 in the longitudinal side 98 of the actuating slide 72, the depth of which approximately corresponding to half of the diameter of the compression spring 96 and the length of which being designed to correspond to the length of the slack compression spring 96 (FIG. 21). The elongated opening 83 on the other hand is provided with a clearance 101 at its side pointing towards the actuating slide 72. This clearance 101 extends from the mouth of the elongated opening 83 in the housing 70 and ends at the end of the elongated recess 100 in the actuating slide 72, with the locking bolt 71 being in a locking position, i.e. with the actuating slide 72 being pushed completely into the elongated opening 83 (FIG. 21). In the shown embodiment of the coupling piece, the prestressed compression spring 96 is therefore braced on the one hand against the bottom 82 of the clearance 101 in the housing and on the other hand against the outer end 103 of the elongated recess 100 in the actuating slide 72 (FIG. 21).

Alternatively it is possible to provide coupling pieces with longitudinally shiftable actuating slides 22 or 72 designed in the above-described way with multiple-part housings.

Figure 18:
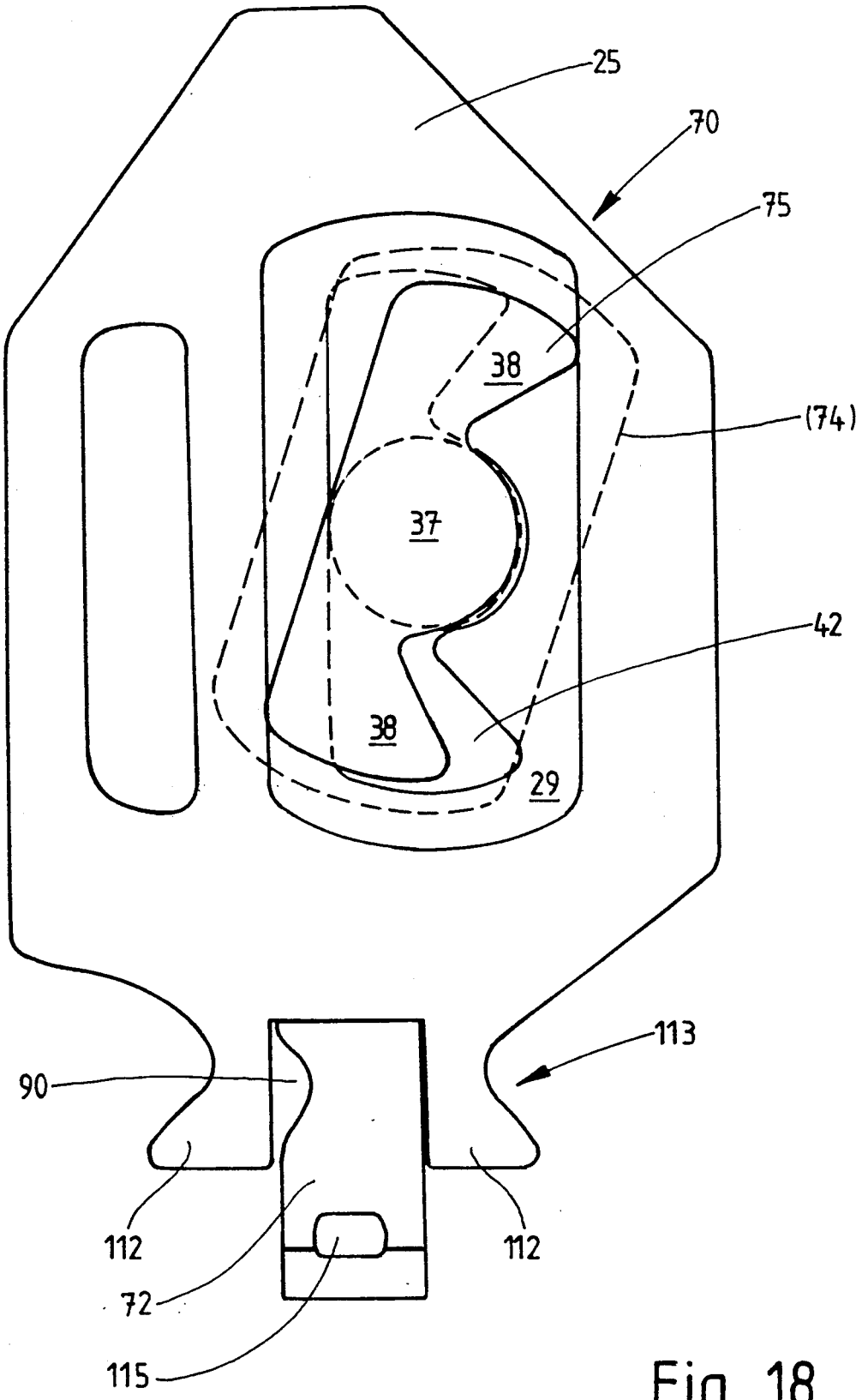
FIG. 18 is a view of the coupling piece as shown in FIG. 17 from underneath.

The coupling pieces of FIGS. 12 to 21 are assembled such that first the locking bolt 71 is inserted into the housing 70 in an assembly position, i.e. with the (lower) crossbar 75 being congruent with the passage 42 in the housing 70. For this purpose, the (lower) crossbar 75 is pushed through the passage 42 of the housing 70 from above, so that it projects on the other side from the lower middle piece 29 of the housing 70 (FIG. 12). Then, the locking bolt 71 is turned by approximately 180°, which moves the (lower) crossbar 75 out of congruence with the passage 42 approximately into a partially released position (FIGS. 17 or 18). Then the compression spring 96 is inserted into the housing 70, specifically into the end of the elongated opening 83 for the actuating slide 72. If necessary this can also be done before insertion of the locking bolt 71. Furthermore, the spring 88 with the lock-in bolt 87 is inserted into the location bore 89 via the through bore 92 of the housing extending transverse to the elongated opening 83. Finally, the actuating slide 72 is thereafter pushed into the elongated opening 83 of the housing 70 from the outside, until the lock-in ball 87 engages the front depression 91 and thus secures the actuating slide 72 against falling out of the housing 70. Herewith, the assembly of the coupling piece is completed.

The coupling piece is dismantled with the actuating slide 72 being in a partially released position (FIGS. 17 and 18), i.e. with the lock-in ball 87 resting in the front depression 91. In this position of the actuating slide 72, the lock-in ball 87 can be disengaged from the depression 72 by means of an appropriate tool which is pushed through the through bore 92 in the housing and the longitudinal bore 93 in the actuating slide 72. Said actuating slide 72 can thus be pulled out of the housing 70. Then, the locking bolt 71 is again turned by nearly 180° in the housing so that the (lower) crossbar 75 is congruent with the passage 42 and can be pulled out of the housing 70.

Figure 16:
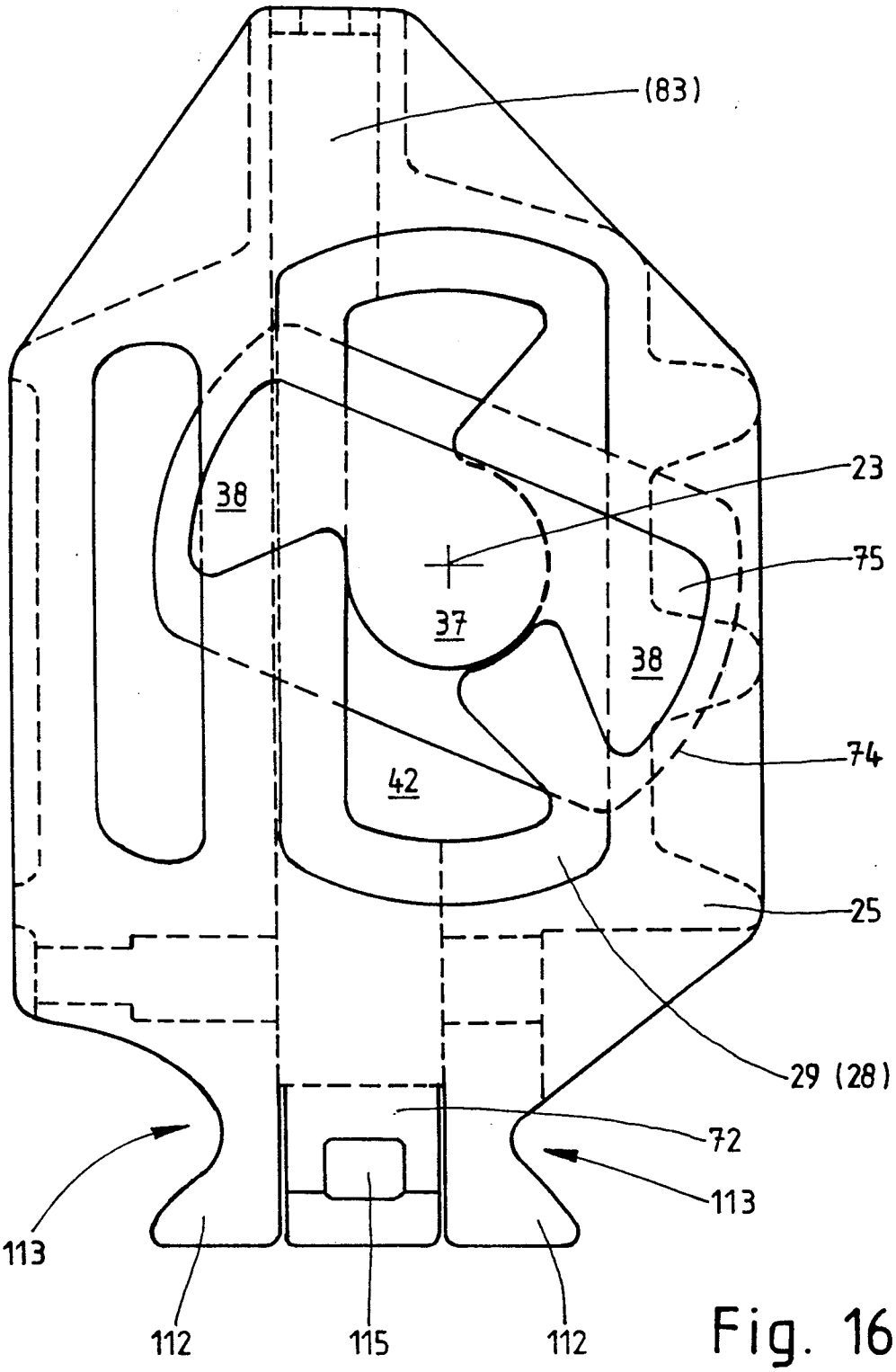
FIG. 16 is a view of the coupling piece as shown in FIG. 15 from underneath.
Figure 19:
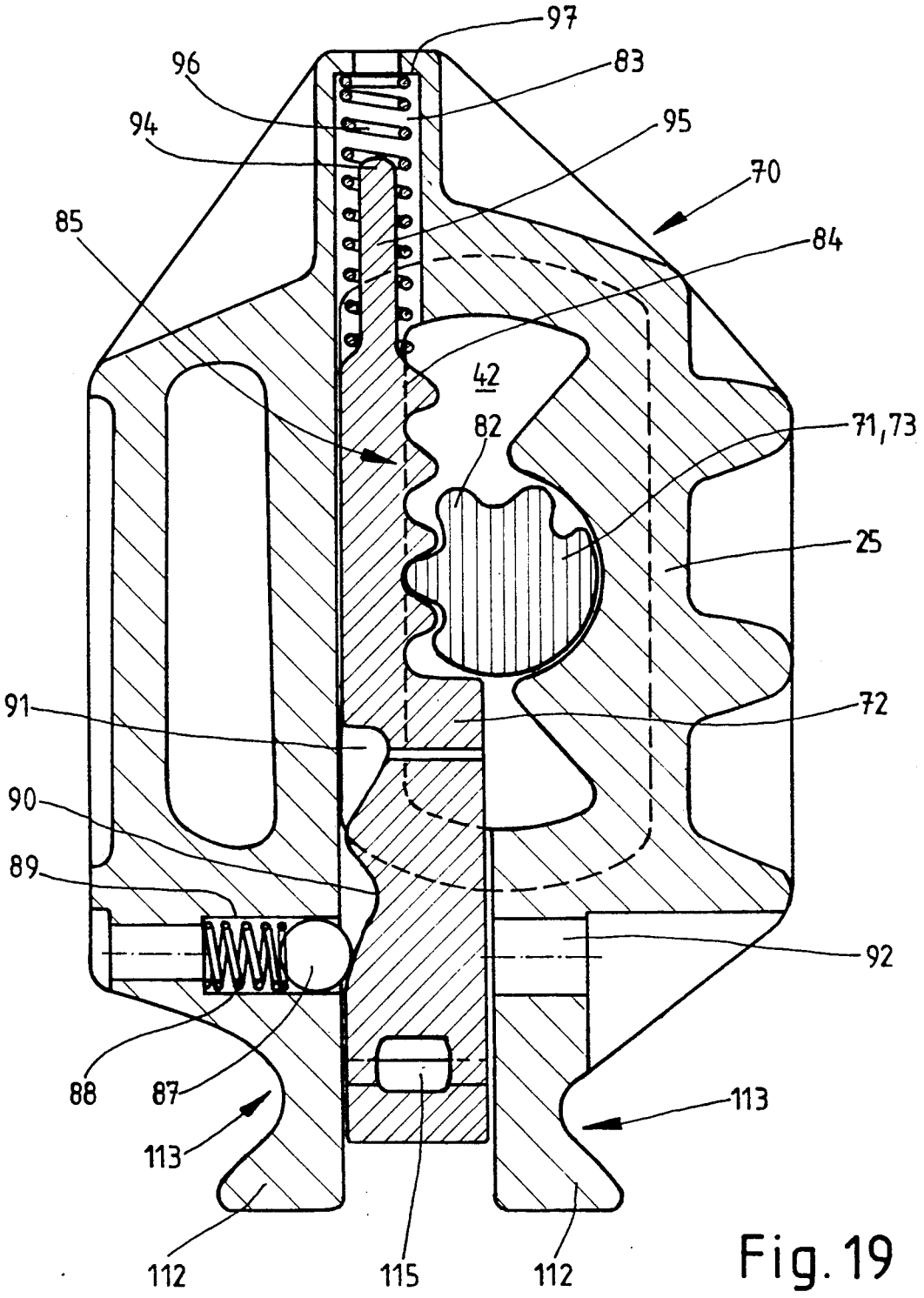
FIG. 19 is a horizontal section through the coupling piece as shown in FIG. 12 in a completely released position.

The coupling piece according to the second embodiment (FIGS. 12 to 20) is locked and released in the following way:

Starting out from a locked or partially released position of the coupling piece, i.e. with the compression spring 96 being slack (FIGS. 15 . . . 18), the (lower) crossbar 75 is manually turned clockwise, so that said (lower) crossbar 75 and also the (upper) crossbar 74 are brought into congruence with the respective middle pieces 28, 29, and the actuating slide 72 is simultaneously moved into the housing 70 far enough for the compression spring 96 to be prestressed (FIGS. 19, 20). In this position of the crossbars 74, 75, the coupling piece can be put into place underneath the lower corner fitting of an upper container and locked (prelocked) thereto, because the actuating slide 72 is moved back into a locking position of both aligned crossbars 74, 75 by the prestressed compression spring after the (lower) crossbar 75 has been let go of (FIGS. 15 and 16). In this position, in which the actuating slide 72 is completely in the housing 70, said actuating slide 72 is secured by the lock-in ball 87 engaging the back depression 90 (FIG. 15). At this point, the actuating slide 72 is completely inside the housing 70 and flush therewith.

When the upper container with the coupling piece hanging underneath is lowered onto the upper corner fitting of the lower container, the (lower) crossbar 75, due to its helicoidal winding 79, is moved back into the completely released position (FIGS. 19 and 20) while the compression spring 96 is again prestressed. In this position, the (lower) crossbar 75 can be inserted into the upper corner fitting of the lower container.

As soon as the upper container has been completely lowered onto the lower container, the energy stored by the stressed compression spring 96 is released and moves the actuating slide 72 back into the locking position. Herewith, the locking bolt 71 is respectively turned counterclockwise. Both crossbars 74, 75 are thus brought out of congruence with the respective middle pieces 28, 29 (FIG. 16).

The coupling piece can be released by partly pulling the actuating slide 72 out of the housing 70, until the lock-in ball 87 engages the front depression 91 of the actuating slide 72, thus preventing the actuating slide 72 from being pulled further out of the housing 70. Herewith, the locking bolt 71 is further turned counterclockwise, until the (lower) crossbar 75 having a smaller cross-section than the (upper) crossbar 74, is disengaged from the upper corner fitting of the lower container. In this position, the longitudinal axes 76, 77 of both crossbars 74, 75 are still in a slightly offset position relative to the longitudinal axis of the respective middle piece 28, 29, so that the (upper) crossbar 74 is still locked in the lower corner fitting of the upper container, i.e. the locking bolt 71 is in a partially released position, although the (lower) crossbar 75 at the upper corner fitting of the lower container (FIG. 18) is released. Now, the upper container can be lifted off the lower container together with the coupling pieces. The coupling piece can subsequently be released from the upper container by manually turning the locking bolt 71 clockwise at the (lower) crossbar 75 until the (upper) crossbar 74 is also in congruence with the respective middle piece 28 of the housing 70, so that the coupling piece is also released from the lower corner fitting of the upper container and can be removed. Starting out from this position of the locking bolt 71, the coupling piece can again be used for coupling together other containers.

Since the actuating slide 72 is inside the housing when the coupling piece is in the locking position (FIGS. 15, 16) and projects from the housing 70 when the locking bolt is in the partially released position (FIGS. 17, 18), a workman can easily conduct a visual inspection of the stowed containers to see if all coupling pieces are really (automatically) locked. This inspection is even possible, if purposely or by mistake the coupling pieces are used upside down for connecting adjacent containers, i.e. if the (lower) crossbar 75 is on top. The coupling pieces could be positioned between adjacent containers in such a way, if they were to be put on the upper corner fitting of the lower containers first before the upper containers were placed on the (prelocked) lower coupling pieces. The position of the actuating slide 72 for identifying the locking condition would herewith not be changed.

Figure 22:
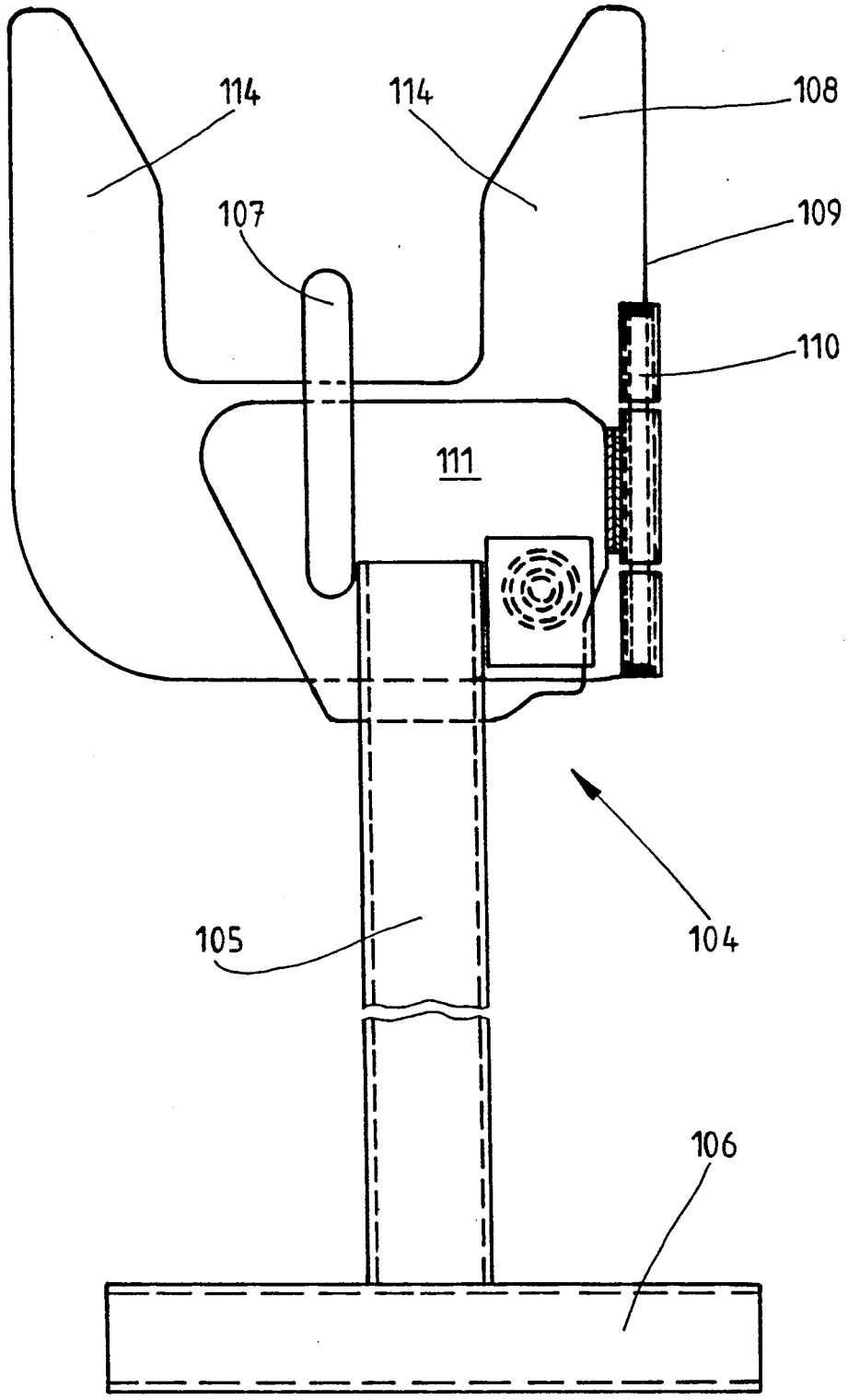
FIG. 22 is an actuating aid for coupling pieces of FIGS. 12 to 21.

In order to partially release the coupling pieces, i.e. to partially pull the actuating slide 72 out of the housing 70 (FIGS. 15 and 17), a special actuating aid 104 can be employed (FIG. 22). Said actuating aid includes a pipe 105 of appropriate length which can be pushed through between adjacent container stacks and which has a transverse handle 106 at its upper end and a keeper pin 107 and a U-shaped guide 108 pivotable thereto. The guide 108 is pivoted via a hinge 110 arranged at an outer edge 109 of the guide 108 at a pivoting plate 111 for holding the keeper pin 107, said pivoting plate 111 being attached to the lower end of the pipe 105.

The housing 70 on the one hand and the actuating slide 72 on the other are designed to correspond to the actuating aid 104. The housing 70 comprises tongues 102 at both sides next to the elongated opening 83 for the actuating slide 72 having an outer depression 113 each, which the guide 108 of the actuating aid 104 engages with its opposite legs 114. The actuating slide 72 on the other hand has an opening 115 in its outer end region, which is accessible from the outside for receiving the keeper pin 107 when the coupling piece is in the locking position, i.e. when the actuating slide 72 is lying between the tongues 112 of the housing 70.

When the coupling piece is in the locking position, the actuating aid 104 is attached thereto such that the legs 114 of the guide 108 are supported in the depressions 113 of opposite legs 114 of the housing 70 while the keeper pin 107 enters the opening 115 of the actuating slide 72. By subsequently turning the pipe 105 about its longitudinal mid-axis, the pivoting plate 111 with the keeper pin 107 is pivoted relative to the guide 108 about the lateral hinge 110 so that the actuating slide 72 is pulled out of the housing 70 until the lock-in ball 87 engages the front depression 91 (FIG. 17) which partially releases the coupling piece for releasing the connection between two superposed containers.

I claim:

1. A coupling piece for releasably connecting corner fittings of adjacent containers, especially of containers stacked on top of one another on board a ship, comprising a housing, a locking bolt mounted rotatably in the housing, oppositely situated crossbars disposed on the locking bolt, a rigid actuating means mounted in the housing in a longitudinally shiftable manner and mechanically engaged to said locking bolt in order to rotate said locking bolt between a release and a locking position by means of a longitudinal shift of said actuating means, and at least one spring means for longitudinally shifting said actuating means to at least partially automatically rotate said locking bolt, said actuating means being securable in said housing in two alternative positions by a lock-in means determining the alternative positions of said actuating means in said housing.

2. A coupling piece for releasably connecting corner fittings of adjacent containers, especially of containers stacked on top of one another on board a ship, comprising a housing, a locking bolt mounted rotatably in the housing, oppositely situated crossbars disposed on the locking bolt, a rigid actuating means mounted in the housing in a longitudinally shiftable manner and mechanically engaged to said locking bolt via a gear coupled with a middle part of the locking bolt in order to rotate said locking bolt between a release and a locking position by means of a longitudinal shift of said actuating means, and at least one spring means for longitudinally shifting said actuating means to at least partially automatically rotate said locking bolt.

3. A coupling piece for releasably connecting corner fittings of adjacent containers, especially of containers stacked on top of one another on board a ship, comprising a housing, a locking bolt mounted rotatably in the housing, oppositely situated crossbars disposed on the locking bolt, a rigid actuating means mounted in the housing in a longitudinally shiftable manner and mechanically engaged to said locking bolt in order to rotate said locking bolt between a release and a locking position by means of a longitudinal shift of said actuating means, and at least one spring means for longitudinally shifting said actuating means to at least partially automatically rotate said locking bolt, said actuating means being spring-loaded, along its mid-axis, in a direction out of the housing by means of a compression spring disposed in said housing which is braced against said housing at one end and against an end of said actuating means located within said housing at the other end.

* * * * *